United States Patent [19]

Sasaki et al.

[11] 4,262,347

[45] Apr. 14, 1981

[54] ELECTRONIC TIMEPIECE

[75] Inventors: Seiko Sasaki; Kazuhiro Asano, both of Tokyo, Japan

[73] Assignee: Kabushiki Kaisha Daini Seikosha, Tokyo, Japan

[21] Appl. No.: 906,559

[22] Filed: May 16, 1978

[30] Foreign Application Priority Data

May 20, 1977 [JP] Japan ..... 52/58392

[51] Int. Cl.[3] ..... G04C 15/00

[52] U.S. Cl. ..... 368/62; 368/155

[58] Field of Search ..... 58/23 R, 50 R, 85.5; 368/62, 69, 82–84, 155–157, 201

[56] References Cited

U.S. PATENT DOCUMENTS 4,150,535 4/1979 Morokawa et al. ..... 58/23 R

*Primary Examiner*—Vit W. Miska

*Attorney, Agent, or Firm*—Robert E. Burns; Emmanuel J. Lobato; Bruce L. Adams

[57] ABSTRACT

An electronic timepiece including a ROM program memory for storing a program, a program counter for addressing the program memory, and a RAM data memory. An operating circuit including an arithmetic logic circuit operates on the data. The ROM program memory circuit stores a test program, and the program counter includes preset test means for addressing the test program stored in the ROM program circuit to operate the timepiece according to the test program. The program memory counter also includes jump inhibiting means for inhibiting execution of the operating program stored in the ROM program memory, in response to a jump address.

3 Claims, 11 Drawing Figures

ELECTRONIC TIMEPIECE

BACKGROUND OF THE INVENTION

The present invention relates to an electronic timepiece, and it relates especially to circuitry having a test function for testing a program memory circuit and data memory circuit of the electronic timepiece.

In the conventional type electronic timepiece, to test a set reset function and a counting function of counters has required a combination of an outer switch and a special testing terminal to check a function of a digital timepiece. Namely, a carry or counting function were tested in a short time by applying a signal of several times or several tens of times of a normal oscillating timekeeping frequency. Further a display, set reset, seconds reset and a time correction functions were tested by applying a testing signal where it is possible to obtain a same function as an actual switching operation or not.

However, it is very inconvenient to test a timepiece function of a program memory and data memory by a conventional testing methods because this technique is time consuming.

The present invention aims to eliminate the above noted difficulty and insufficiency, and the object of the present invention is to provide a testing method and function in an electronic timepiece for reducing the length of a testing time by employing a testing program which is able to test a data memory circuit of the timepiece and by executing a program which is memorized in a program memory circuit without a jump operation.

EXPLANATION OF THE DRAWINGS

FIG. 4(*b*) shows signal waveforms of signals developed during the operation of the circuit of FIG. 4(*a*)

DESCRIPTION OF THE PREFERRED EMBODIMENT

Figure 1:
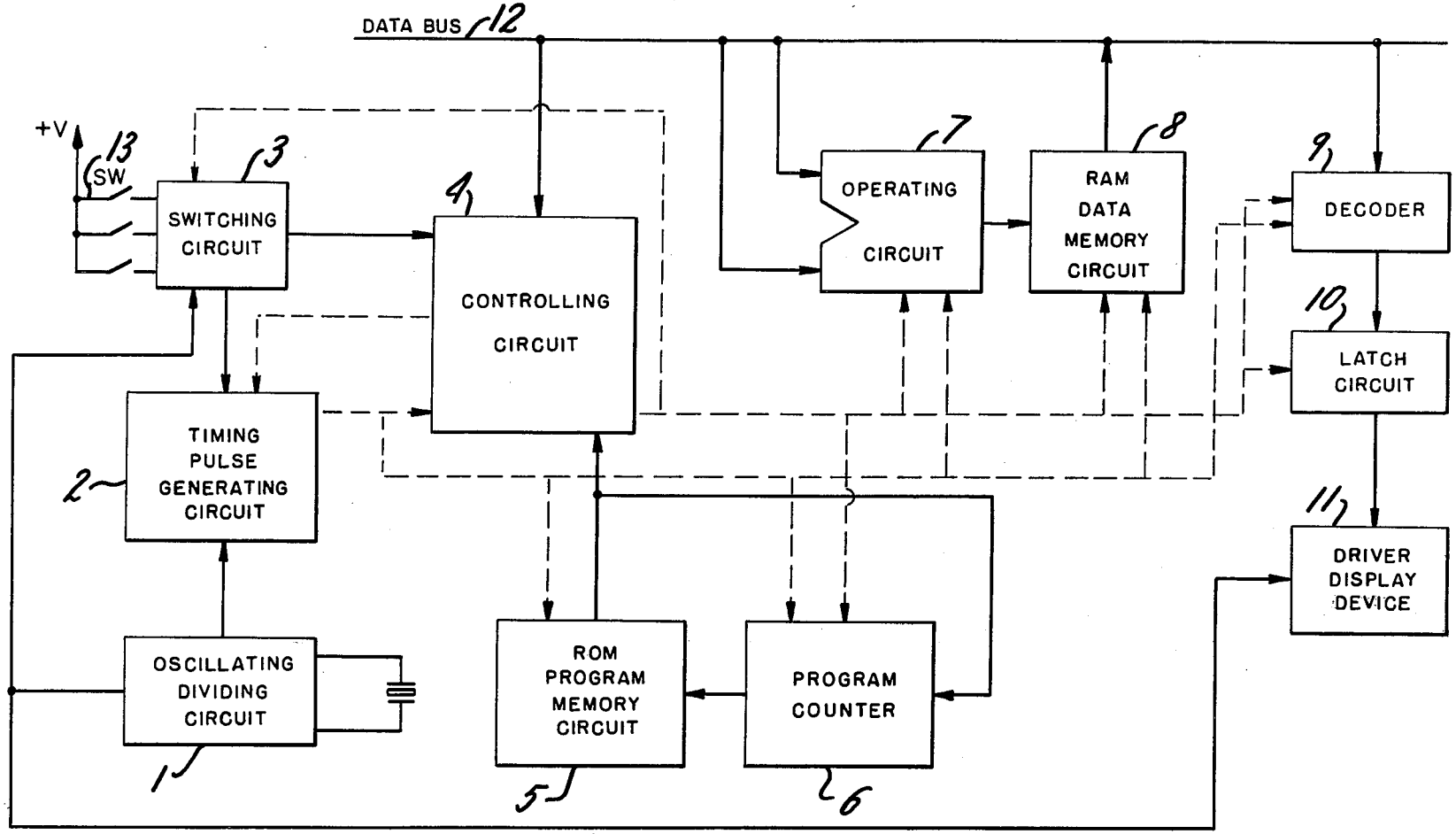
FIG. 1 shows a block diagram of one embodiment of the present invention.

Referring now to a preferred embodiment of the present invention illustrated accompanying drawings:

FIG. 1 shows a block diagram for indicating the entire circuit construction of an electronic timepiece of the present invention. Numeral 1 is an oscillating dividing circuit, developing a output signal which is applied to a timing pulse generating circuit 2, a switching circuit 3 and a driving circuit 11. The timing pulse generating circuit 2 generates a timing pulse by receiving a signal from said oscillating dividing circuit 2, switching circuit 3 and controlling circuit 4. The timing pulse is applied to a controlling circuit 4, a program memory circuit 5, a program counter 6, an operating circuit 7, a data memory circuit 8 and a decoder 9.

Said switching circuit 3 receives a signal of a switch 13 in which one terminal is connected to a high voltage point, a control signal from the controlling circuit 4 and a clock signal from said dividing circuit 1. A switching signal of the switch 13 is shaped to a preferable switching signal waveform by said switching circuit 3, and is applied to said controlling circuit 4. The controlling circuit 4 receives the signals from said program memory circuit 5, a data bus 12, said switching circuit 3 and said timing pulse generating circuit 2, and develops a control signal which is applied to said switching circuit 3, said timing pulse generating circuit 2, said operating circuit 7, said data memory circuit 8, said decoder 9, a latch circuit 10 and said program counter 6.

On the other hand, said program counter 6 receives a present address signal from said program memory 5 and a jump control signal from said controlling circuit 4, and generates a next address signal which is applied to said program memory circuit 5.

The operating circuit 7 receives and operates on a data signal from said data bus 12, according to an operating command signal from said controlling circuit 4, and generates a result of the operation to said data memory circuit 8. The data memory circuit 8 receives a control signal from said controlling circuit 4, and generates data which is applied to said data bus 12.

Said decoder 9 decodes data on said data bus 12 in response to a signal from said controlling circuit 4, and transfers the decoded data as an output to said latch circuit 10. Said latch circuit 10 reads a decoded data signal synchronized to a signal from said controlling circuit 4, and generates an output signal applied to a driving circuit 11.

Referring now to operation of the present invention:

A program for executing a count and display is memorized to said program memory circuit 5.

If a one second pulse signal is generated from said oscillating dividing circuit 1, said timing pulse generating circuit 2 receives said one second pulse signal and generates a timing pulse signal.

Said program memory circuit 5 is started by said timing pulse signal, and generates a program data which is applied to said controlling circuit 4 according to an address which is designated by said program counter 6. Said controlling circuit 4 reads a signal from said program memory circuit 5 and generates the control signals for each section. For instance, seconds figure information in time information which is stored in the data memory circuit 8 is applied to said data bus 12 and executes an adding command "ADD" of said operating circuit 7 and adds "1" to a seconds figure signal. Further discrimination of a carry is executed, and data is applied to the latch circuit 10 via the decoder 9.

These above noted operations are executed by sequentially executing a program which is memorized in said program memory circuit 5.

Finally, a stop command "HLT" is generated from said program memory circuit after the program has completely finished all of the necessary operations, and the command "HLT" is applied to the timing pulse generating circuit 2 via said controlling circuit 4. The timing pulse generating circuit 2 receives the signal and stops generating a timing pulse signal.

At this time, the program counter 6 is simultaneously reset and is maintained in a state so as to start operation from "0" address the next time.

When the one second signal is generated from the oscillating dividing circuit 1, and a switching signal "SWFLG" is applied to the timing pulse generating circuit 2 by switching the switch 13, an operation is executed by a program of the program memory circuit 5.

Figure 2:
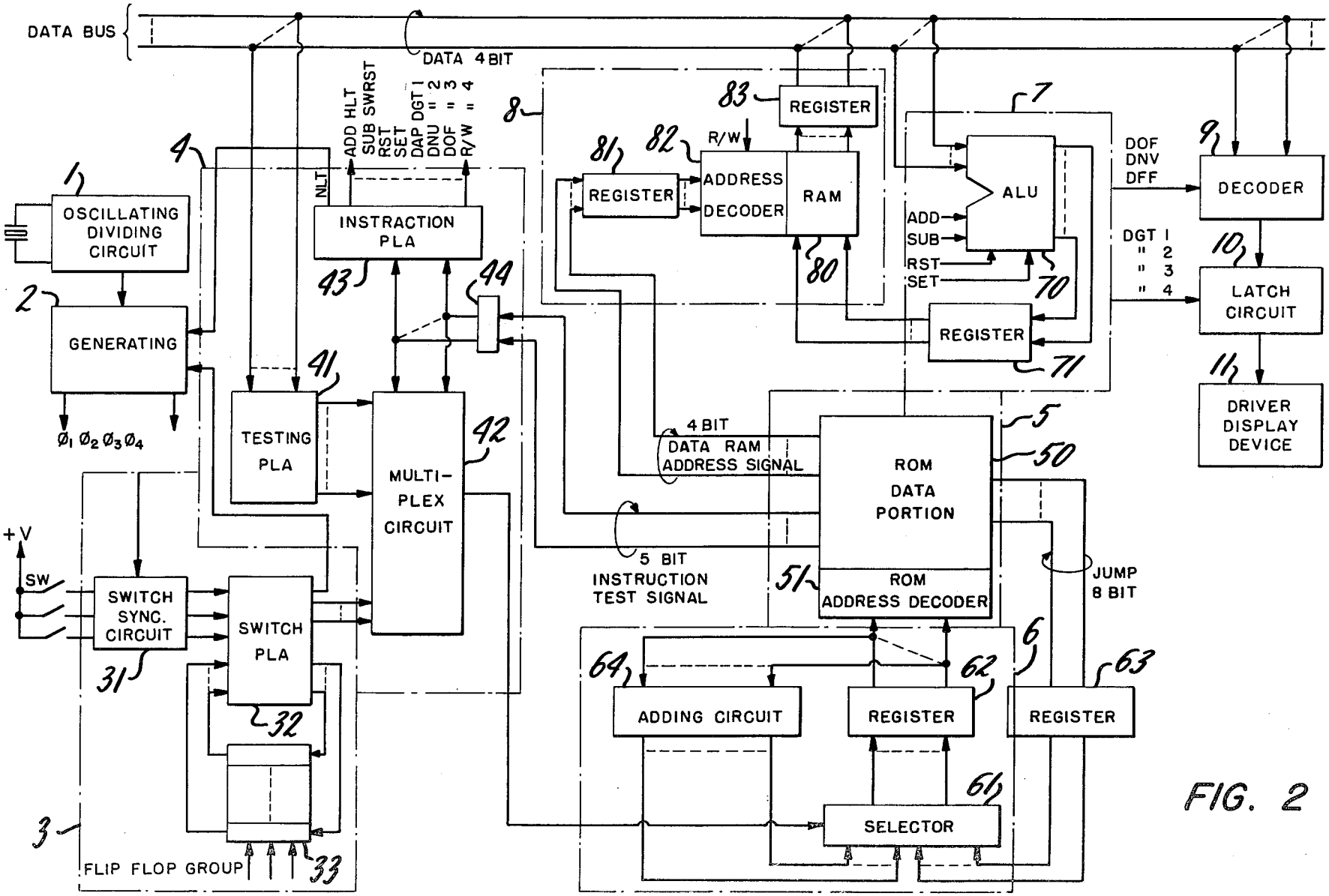
FIG. 2 shows a more detailed block diagram of the embodiment of FIG. 1.

Further, referring now to the detailed construction of the present invention:

FIG. 2 shows a block diagram of the present invention, wherein a switch synchronizing circuit 31 is connected to an outer switch, and an output of said switch is connected to one part of an input to a switch PLA (Programmable Logic Array) 32. An output of one part of said switch-PLA 32 is applied to a flipflop group 33, and an output of said flip flop group 33 is applied to another input terminal of said switch-PLA 32. An another output terminal of said switch-PLA 32 is applied to an input terminal of a multi-plex circuit 42 and the timing pulse generating circuit 2.

The data bus 12 is connected to an input of a test-PLA41 and an output of said test-PLA 41 is applied to another input terminal of said multi-plex circuit 42. An output of the program memory circuit 5 is applied to an another input terminal of said multi-plex circuit 42 via a register 44.

An output of said multi-plex circuit 42 is applied to a control terminal of a selector 61. An output of the program memory 5 is applied to an instruction-PLA 43, and each of its output terminals are respectively connected to the timing pulse generating circuit 2, the switch circuit 3, the program counter 6, the operation circuit 7, the data memory circuit 8, the decoder 9 and the latch circuit 10.

An output of said program memory 5 is applied to one input terminal of the selector 61 via register 63, and an output of an adding circuit 64 is applied to another input terminal of said selector 61. An output of said selector 61 is applied to a register 62.

An output of said register 62 is applied to a ROM address decoder 51, and is also applied to the adding circuit 64. The program memory circuit 5 is composed of a ROM 50 and the ROM address 51.

An operating circuit 7 is composed of ALU 70 (arithmetic logic unit) and a register 71, the data bus is connected to one input terminal of said ALU 70, and a control signal from the instruction PLA 43 is applied to another input terminal of said ALU 70.

An output of said ALU 70 is applied to a register 71, and an output of said register 71 is applied to a RAM 80 of the data memory circuit 8. An output of a ROM 50 is applied to a register 81, and output of said register 81 is applied to a RAM address decoder 82. On the contrary, an output terminal of the RAM 80 is connected to a register 83, and an output terminal of said register 83 is connected to the data bus 12.

Referring now to operation of the present invention illustrated in FIG. 2:

Information for designating an address of the ROM 50 is memorized in the register 62 in the program counter 6. Said register 62 has a capacity of 8 bits, and an output of said register 62 is applied to a ROM address decoder 51. A contents of the 8 bits of said register 62 is decoded by the address decoder 51 for generating a signal for designating a certain ROM addresses. In this case, it is possible to provide $2^8=256$ unique signals fo designating ROM addresses, a maximum number of program steps in this embodiment becomes 256, and a number of program steps for executing an operation, a correction and a display should be set to 256.

The content of an address of ROM 50 which was selected by a signal from the ROM address decoder 51 is generated at the output terminals of the ROM, a part of said address contents is applied to the multi-plex circuit 42 and an instruction PLA 43, another part of said address contents is applied to a regsiter 81, and another part of said address contents is applied to the register 63. At this time, data from the RAM 80, namely time information of 4-bits, is applied to the multi-plex circuit 42 via a test-PLA 41 and the data-bus. A signal from the switch PLA 32 is also applied to said multi-plex circuit 42.

The data format of the ROM 50 is composed of two forms: format I (10-bits) and format II (18-bits) as follows:

FORMAT-1

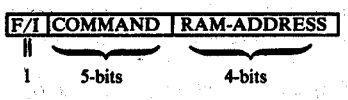

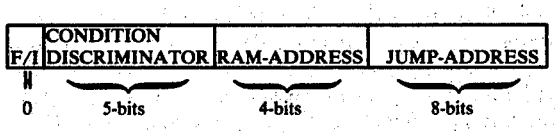

Format I is composed of data stored in the memory circuit having a control command (5-bits) and RAM-address (4-bits) for executing a time count, correction and display. Further Format II is composed of data stored in the memory circuit having a condition discriminator (5-bits), RAM-address (4-bits) and jump address (8-bits). When the F/I bit is "0", the Format becomes Format-1. When the F/I bit is "1", the Format becomes Format-II.

Referring now to a detailed description of part of Formats-1 and II with reference to the accompanying tables:

Table-1 shows RAM-address data and the names of corresponding registers which memorize time information and other information.

For example, the address [0110] is for a register "10H" for storing time information of 10 hours figure, further an address [1110] is for a register "C" for memorizing and counting 10 seconds which is a command display time.

TABLE 1

(RAM data arrangement)

| ADDRESS | REGISTER NAME | CONTENTS OF REGISTER |
|---|---|---|
| 0000 | — | — |
| 0001 | S | Time Memory of 1 second fig |
| 0010 | 10S | Time Memory of 10 seconds fig |
| 0011 | m | Time Memory of 1 minute fig |
| 0100 | 10m | Time Memory of 10 minutes fig |
| 0101 | H | Time Memory of 1 hour fig |
| 0110 | 10H | Time Memory of 10 hours fig |
| 0111 | AP | Memory of AM and PM |
| 1000 | D | Time Memory of 1 day fig |
| 1001 | 10D | Time Memory of 10 days fig |
| 1010 | M | Time Memory of 1 month fig |
| 1011 | 10M | Time Memory of 10 months fig |
| 1100 | F | Select Register |
| 1101 | E | Command Flag |
| 1110 | C | Register for counting 10 secs |

TABLE 1-continued (RAM data arrangement)

| ADDRESS | REGISTER NAME | CONTENTS OF REGISTER |
|---|---|---|
| 1111 | Z | Register for set |

Table-II shows command code arrangement, and the command code is composed of 5-bit combinations and is able to generate 25 different commands. For example, code (00100) adds [1] to data in the RAM80 of RAM-address decodes 82, and is designated by a command "ADD" and writes the results in the RAM80 at an address designated by said RAM address decoder 82. Similarly, code [110xx] controls a decoder by a command "DAP" whereby a AP display (AM or PM) is displayed. Further code [1xx00] latches data to a first display figure by a command "DGT1"

TABLE II

Command code arrangement

| CODE | COMMAND | ACTION | |
|---|---|---|---|
| 000 00 | NOP | NO OPERATION | |
| 001 00 | ADD | [D] ← [D] + 1 | ALU CONTROL |
| 010 00 | RST | [D] ← [0000] | ALU CONTROL |
| 011 00 | SET | [D] ← [0001] | ALU CONTROL |
| 001 01 | SUB | [D] ← [D] − 1 | ALU CONTROL |
| 001 10 | SWRST | SW FLAG RESET | |
| 111 11 | HLT | CLOCK STOP | |
| 100 xx | DNU | DISPLAY | DECODER CONTROL |
| 101 xx | DOF | DISPLAY OFF | DECODER CONTROL |
| 110 xx | DAP | DISPLAY AP | DECODER CONTROL |
| 1xx 00 | DGT1 | FIRST FIG LATCH | |
| 1xx 01 | DGT2 | SECOND FIG LATCH | LATCH CONTROL |
| 1xx 10 | DGT3 | THIRD FIG LATCH | LATCH CONTROL |
| 1xx 11 | DGT4 | FOURTH FIG LATCH | LATCH CONTROL |

([D] means data in RAM80)

Therefore, according to command information of 5-bits of Format-1, an operation, correction and display of a time information are executed by the control signals.

Table-3 shows a code arrangement of a condition discriminator which is composed of 5-bits, and generates the signals for discriminating many conditions.

In case of a normal time count, an operated time and a present time are necessarily compared to execute a carry, set and reset, and data for executing the above noted comparison is applied thereto. Further a set, reset or switch of a display are necessarily executed by an information from an outer or external switch, and data for executing the above operation is applied thereto.

TABLE 3

(a code in a condition discriminator)

| CODE | CON-DITION | CODE | CON DITION | CODE | CON-DITION |
|---|---|---|---|---|---|
| 00000 | 1 | 01010 | INC3 | 10100 | =2 |
| 00001 | ϕ | 01011 | INC4 | 10101 | ≠2 |
| 00010 | ST | 01100 | SWFLG | 10110 | ≠3 |
| 00011 | SRST | 01101 | | 10111 | =3 |
| 00100 | INC | 11110 | ≠4,6,9 | 11000 | =4 |
| 00101 | FNC | 11111 | =15 | 11001 | ≠4 |
| 00110 | COM | 10000 | =0 | 11010 | =6 |
| 00111 | SRST | 10001 | ≠0 | 11011 | =8 |
| 01000 | INC1 | 10010 | =1 | 11100 | =10 |
| 01001 | INC2 | 10011 | ≠1 | 11101 | ≧3 |

A jump address (8-bits) of Format II compares the contents of a condition discriminator (5-bits) and the contents of being applied to a multi-plex circuit 42, and it jumps to the address when a compared result is "No" or "Ie"

Referring now to Format-I and Format-II for describing a detailed action:

In case Format-I,

A one output of ROM50, namely a RAM address (4-bits) is applied to a register 81 (4-bits), another output of ROM50, namely a command (5-bits), is only applied to an instruction PLA43 via a register 44 since F/I is "1"

The data of 4-bits which was applied to a register 81 is applied to a RAM address decoder 82, and selects a certain RAM address, and reads data which is memorized in a RAM80, and applies said data to the data-bus 12.

The data of 5-bits which was applied to the instruction PLA43 is translated and read by said instruction PLA43, and controls operation of RAM80 and ALU70, and executes transference and operation of time information data. For example, if the outputs [$D_0$, $D_1$, $D_2$, $D_3$, $D_4$, $D_5$, $D_6$, $D_7$, $D_8$ and $D_9$] of ROM data are [1001000001], $D_0$=F/I, $D_1$–$D_5$=command, $D_6$–$D_9$=RAM address. A command "ADD" is generated from said TABLE-2 since $D_0$=1 and $D_1$–$D_5$=[00100] in Format I, and a time memory of one second figure is indicated in a register "S" according to TABLE-1 since $D_6$–$D_9$ is [0001].

Therefore, data of 10-bits which was generated from the ROM50 applies data of a register "S" of ROM80 to a data-bus 12 via a register 83. [1] is added to the data on said data-bus by a control signal which was translated and decoded to a command [ADD] from said instruction PLA43, and the result of the addition is stored in the register "S" of ROM80 via a register 71.

At this time, read and store commands of data of RAM80 are generated from an instruction PLA43 accompanying said command "ADD", and are applied to the data memory 8 and control said data memory.

In case of Format II,

Another output (8-bits) is applied to a selector 61 via a register 63.

In this case, data of a condition discriminator of 5-bits is only applied to a multi-plex circuit 42 since F/I is "0". Data of 4-bits which was applied to a register 81 is applied to the RAM address decoder 82, and selects a certain RAM address, and reads data which is memorized in RAM80, and applies said data to the data-bus. Data of 5-bits of the condition discriminator is applied to the multi-plex circuit 42 via the register 44, and selectively generates an output after selected by the output from a test PLA 41 which is applied to multi-plex circuit 42 and an output from a switch PLA 32. An output signal from the multi-plex circuit 42 is applied to selector 61, and controls a selection of the output signals of the adding circuit 64 and register 63.

When a signal of the switch PLA 32 or the test PLA 41 and a test signal from the ROM coincide, a next executing ROM address adds "1" to an executing ROM address, and selects an output from the adding circuit 64 so as to be set in the register 62 as a next executing ROM-address.

On the contrary, when a signal of the test PLA 41 or the switch PLA 32 and a test signal from the ROM do not coincide, information in the register 63 in which a data of 8-bits of a jump address is applied thereinto is selected so as to enable a next executing ROM address to jump from an executing ROM address, and sets to a register 62.

For example, if the outputs of ROM-data [$D_0$, $D_1$, $D_2$, $D_2$, $D_2$, $D_4$, $D_5$, $D_6$, $D_7$, $D_8$, $D_9$, $D_{10}$, $D_{11}$, $D_{12}$, $D_{13}$, $D_{14}$, $D_{15}$, $D_{16}$ and $D_{17}$] are [01111111101-0000000], $D_0$ is F/I, $D_1$–$D_5$ are a condition discriminator, $D_6$–$D_9$ are a RAM address, $D_{10}$–$D_{17}$ are a jump address.

Further $D_0=0$ since in Format II, a condition=15 is obtained from TABLE-3 since $D_1$–$D_5$ are [11111], 2-seconds counting register is indicated in a register "C" since $D_6$–$D_9$ are [1110], an address "80" (shown in 16-counting) is indicated since $D_{10}$–$D_{17}$ are [10000000]. If an executing ROM address is an address "40" (shown in 16 counting), a jump address indicates an address "80".

Data in the register "C" of RAM-80 is applied to the data-bus 12 via the register 83 since a RAM address signal of the ROM output is [1110], said data is applied to the test PLA 41, and an output of said test PLA 41 is applied to the multi-plex circuit 42. Data of the condition discriminator is applied to the multi-plex circuit 42 via a register 44. Further a data of a jump address is applied to the selector 61 via the register 63. Data of an address "40" which is an executing ROM address is set in the register 63, the adding circuit 64 generates "41" in which "1" is added to a present address, and the sum is applied to the selector 61.

Therefore, when a data on a data-bus 12 namely content of the register "C" and content of the condition discriminator of the ROM namely =⌈15⌋ coincided, the output of the adding circuit 64, i.e. the address "41", passes selector 61 and is set in the register 62. In the next executing cycle, a program proceeds according to the contents memorized in an address 41. When the contents of register "C" and the contents of the condition discriminator do not coincide, a jump address "80" which is set in the register 63 passes the selector 61 and is set to a register 62, a program proceeds according to the contents memorized in address "80" in a next executing cycle.

If an output of the multi-plex circuit 42 is H-level according to an action and structure of ROM, a jump address is selected. Further, if an output of the multi-plex circuit 43 is L-level, a plus 1 address is selected, whereby a program which proceeds memorized in the ROM50 is sequentially. Therefore, an operation, correction and display of a time are executed.

Referring now to a display of the present invention:

In this case, data for the display should be located on a data-bus 12, therefore, the construction of the ROM employs a form of Format I. A presence of a display and a display's figure are designated according to a combination of a decoder control command and a latch control command.

When a Format I is [1100100101], $D_0$ is [1] according to a Format-I, $D_1$–$D_5$ are [10010], namely $D_1$–$D_3$ has a command ⌈DNU⌋ for displaying the RAM data, $D_4$–$D_5$ has a command [DGT3] for latching the data to a display figure.

The set of bits $D_6$–$D_9$ displays a RAM address ⌈H⌋ by [0101] and displays a time memory 1 hour figure.

Therefore, said ROM-data designates a RAM-address ⌈H⌋ and applies contents of ⌈H⌋ to the data-bus 12 via the register 83 to a decoder 9. At this time, simultaneously a latch command and a display command are generated, a time information, namely the one hour figure which was applied to the decoder 9, is decoded to a display segment signal by said decoder 9 according to a display command, and is applied to a latch circuit 10.

Display data which is applied to the latch circuit 10 is latched to a memory circuit which corresponds to a one-hour figure, namely 5-bits, according to a latch command. The latched display data is applied to a driver display device 11 whereby a certain time information represented by the latched display data is displayed.

A timecorrection and a display selection are executed by operation of an outer or external switch. Namely, in response to ON or OFF of the switch, an electric signal including a chattering signal is applied to a switch synchronizing circuit 31. Said switch synchronizing circuit 31 eliminates chattering, a switching signal is synchronized by a certain frequency, and the switching signal is generated during an executing cycle time of all of the program. An output signal from said switch synchronizing circuit 31 is applied to a switch PLA 32, and is changed to a certain signal. A part of the output signal of the switch PLA 32 is applied to the multi-plex circuit 42 and another part of said output signal is applied to a flip flop group 33 for memorizing present information. An output of said flip flop group 33 is returned to said switch PLA 32.

The switch PLA 32 generates the following output signals:

FNC . . . signal for selecting a correction figure in a correcting operation

INC . . . time correcting signal

COM . . . display selecting signal

SRST . . . second reset signal

These switching signals are compared with condition discriminating data which was generated from ROM50 by the multi-plex circuit 42 whereby these switching signals become data (information) for discriminating the condition of a jump of a next executing adress of the ROM or a plus one adress.

Figure 3:
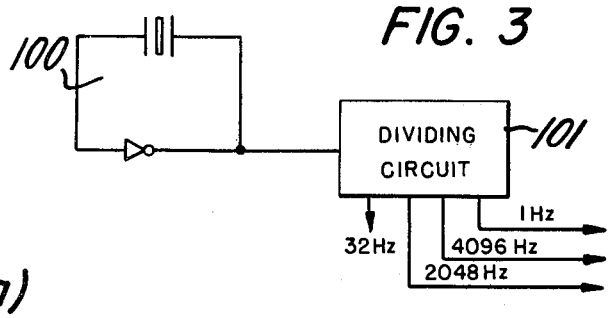
FIG. 3 shows an oscillating and dividing circuit construction.

Further referring now to detailed structure of each circuit block:

FIG. 3 shows an oscillating dividing circuit wherein an output of a standard signal generating circuit 100 is applied to a dividing circuit 101. The 4096 Hz and 2048 Hz signals are outputs of said dividing circuit 101 and are applied to a timing pulse generating circuit illustrated in FIG. 4 as a clock signal. The 1 Hz output signal is applied to said timing pulse generating circuit as a time standard signal.

Figure 5:
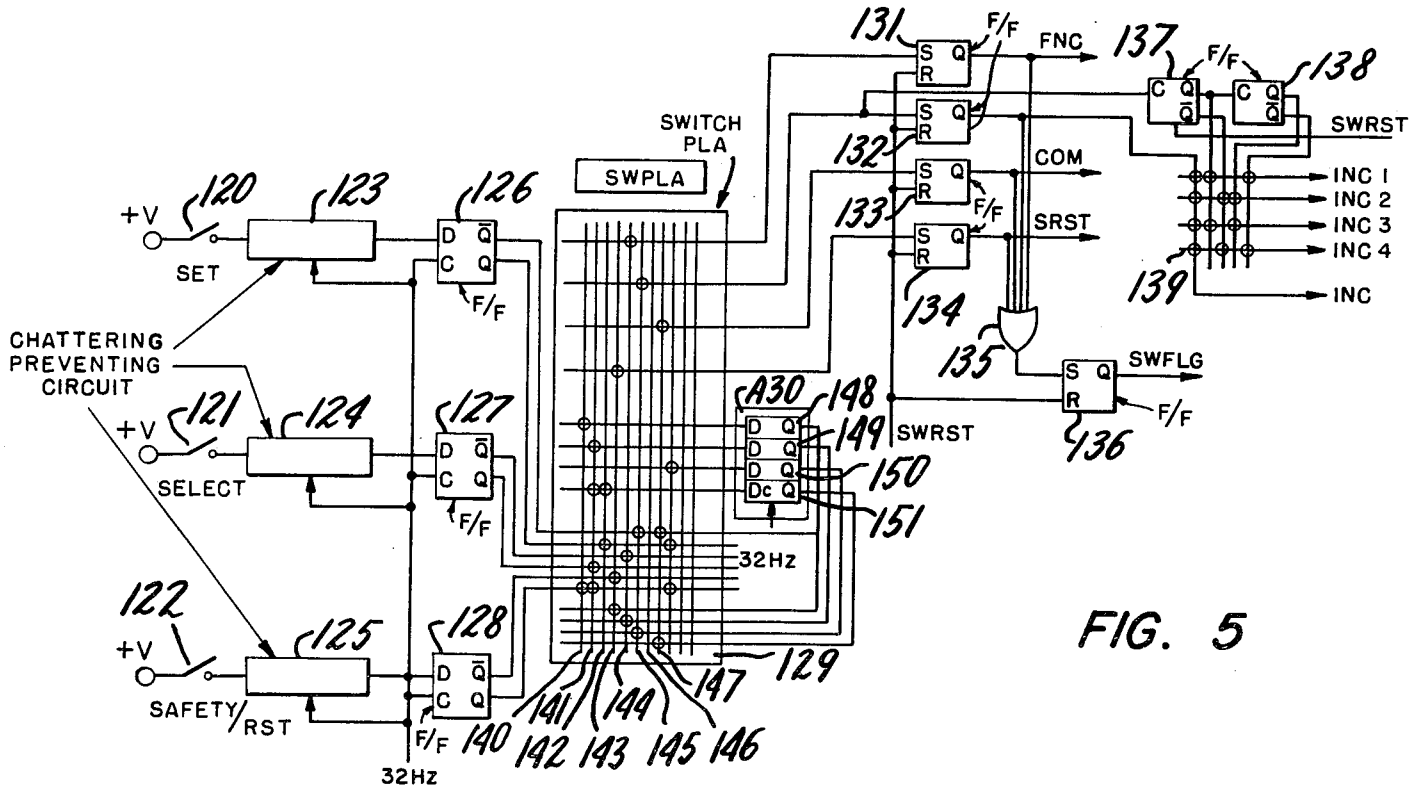
FIG. 5 shows a switching circuit constructions.
Figure 7:
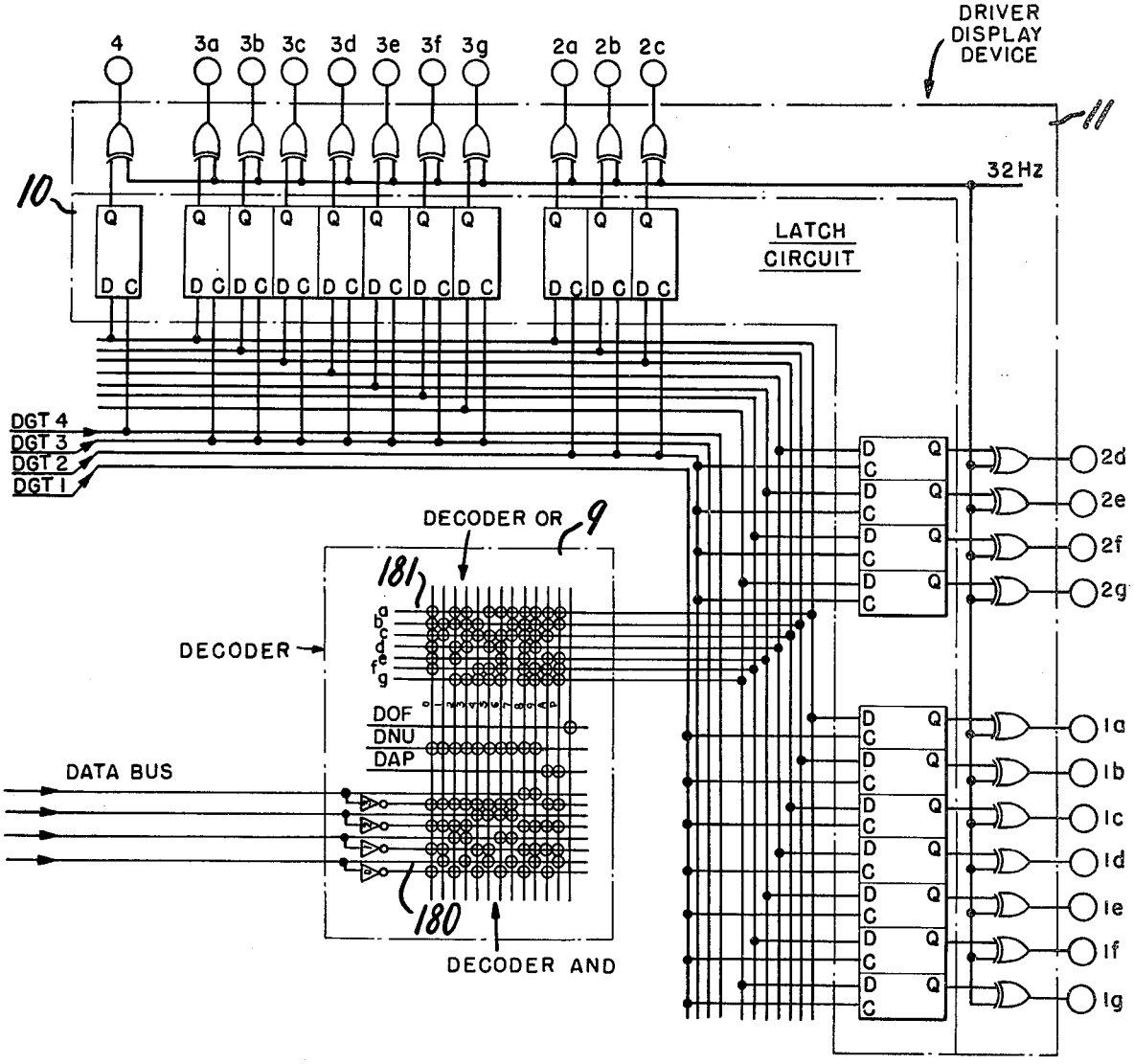
FIG. 7 shows circuit construction of a decoder, latch and driver.

The 32 Hz output signal of said dividing circuit 101 is connected to a switch circuit illustrated in FIG. 5 and a display circuit illustrated in FIG. 7 as a clock signal of switch and display portions.

Figure 4A:
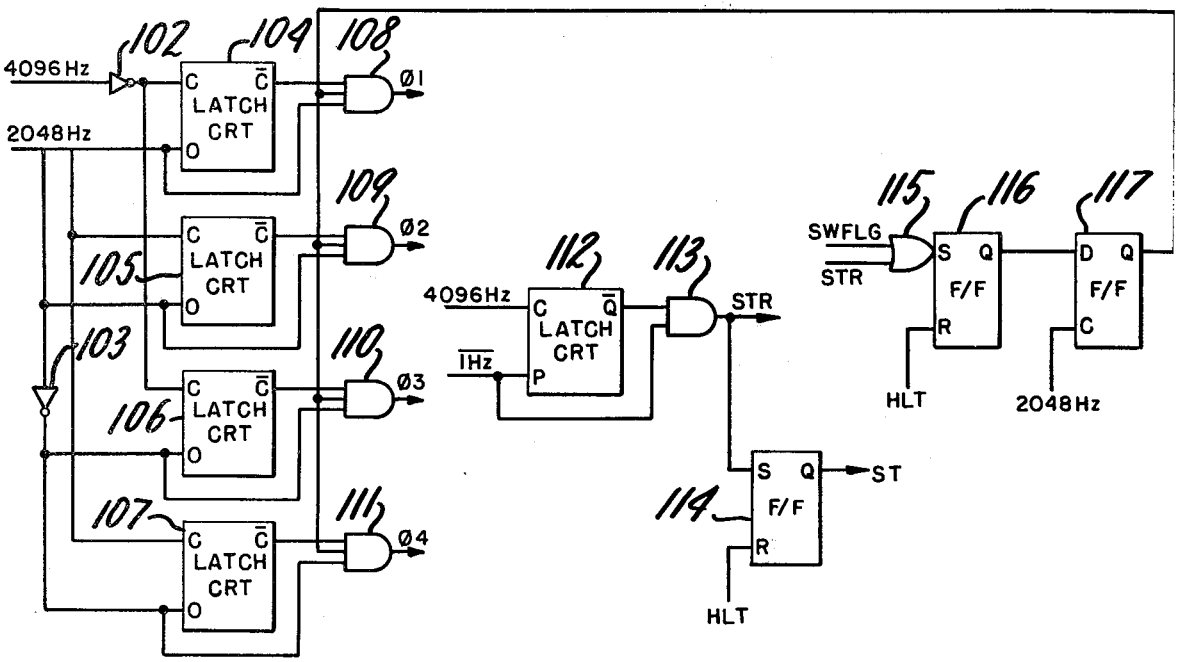
FIG. 4(*a*) shows a timing pulse generating circuit construction.
Figure 4B:
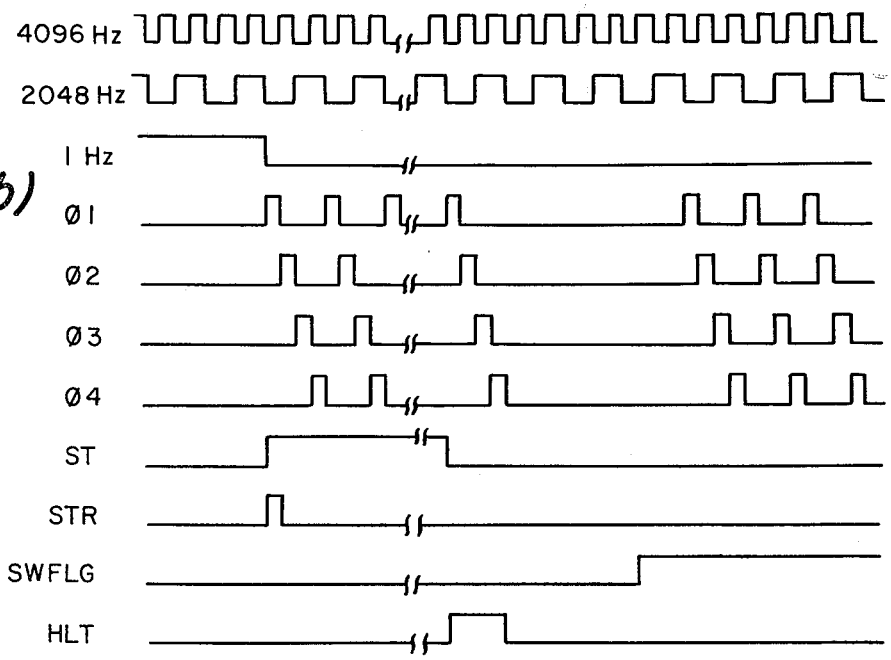

FIG. 4(*a*) shows a timing pulse generating circuit. The 4096 Hz output of the dividing circuit 101 is applied to a clock terminal of latch circuits 105 and 107, and an inverted signal is applied to latch circuits 104 and 106 via an 4096 Hz inverter 102.

Further, a 2048 Hz output of the dividing circuit 101 is applied to a data terminal of said latch circuits 104 and 105, and an inverted 2048 Hz signal is applied to a data terminal of said latch circuits 106 and 107.

The data terminals of latch circuits 104–107 and the first terminal of AND gates 108–111 are respectively connected, and outputs $\bar{Q}$ of said latch circuits 104–107 and second terminals of AND-gates 108–111 are respectively connected. Further, third inputs of AND-gates 108–111 are respectively connected and are connected to an output of D-F/F117. The outputs of AND-gates 108–111 are connected to another block as the clock signals $\phi_1$–$\phi_4$.

On the other hand, A 1 Hz output of the dividing circuit 101 is connected to a data terminal of a latch circuit 112 and to one input of AND-gate 113 after being inverted, 4096 Hz after a phase was inverted, 4096 Hz of an output of said dividing circuit 101 is applied to a clock terminal of a latch circuit 112.

An output $\overline{Q}$ of a latch circuit 112 is connected to another input terminal of AND-gate 113, and an output STP of AND-gate 113 is connected to one input terminal of OR-gate 115 and a set terminal of S-RF/F114.

The HLT-signal from the control circuit is applied to a reset input terminal of said S-RF/F114, and an output signal ST thereof is connected to a control circuit. A signal SWFLG from a switching circuit is applied to another input terminal of OR-gate 115, and an output of said OR-gate 115 is applied to a set terminal of S-RF/F116.

The HLT signal from a control circuit is also connected to a reset terminal of S-RF/F116, and an output Q of said S-RF/F116 is applied to a data terminal of DF/F117.

The 2048 Hz output of the dividing circuit 101 is applied to a clock terminal of DF/F117.

Referring now to the operation in the above described timing pulse generating circuit:

When S-RF/F116 was reset, the outputs $\phi_1$–$\phi_4$ of AND-gates 108–111 are "L"-level since an output Q of DF/F117 is "L"-level.

Further, the $\overline{1Hz}$ signal is constantly delayed 120 $\mu$s by the latch circuit 112. When said $\overline{1\ Hz}$ signal is changed from "L"-level to "H"-level in the above noted condition, a standard pulse signal STP of about 120 $\mu$ sec occurs at an output terminal of AND gate 113. When said STP changes to "H"-level, S-RF/F116 is set via OR-gate whereby an output Q of DF/F117 becomes "H"-level, and signals $\phi_1$–$\phi_4$ are generated since the third inputs of AND-gates 108–111 become "H"-level.

Said signals $\phi$–$\phi_4$ are generated until a signal HLT is generated from the control circuit, and said signals $\phi_1$–$\phi_4$ are stopped when said signal HLT became "H"-level and said S-RF/F116 is reset. At this time, said S-RF/F114 for generating a flag signal STP is similarly reset. Signals $\phi_1$–$\phi_4$ are generated by a signal SWFLG which is changed to "H"-level.

Therefore, said signals $\phi_1$–$\phi_4$ are generated whenever said STP signal becomes "H" level once per second or said SWFLG signal is changed to "H"-level by operating a switch. The signals $\phi_1$–$\phi_4$ are stopped when a signal HLT from the control circuit became "H"-level. The above noted condition is shown by timing chart of FIG. 4 (*b*).

Referring now to a switching circuit shown in FIG. 5:

One terminal of each of the switches 120 and 121 is connected to a high voltage terminal of a power source, and another terminal switches is connected to a respective one of the chattering preventing circuits of each of the 123 to 125. The outputs of said chattering preventing circuits 123 to 125 are applied to data terminals of DF/F 126–128, and the outputs Q and $\overline{Q}$ thereof are applied to the AND-section of PLA 129. An output signal 32 Hz of the dividing circuit 101 is applied to the clock terminals of DF/F 126 to 128 and the chattering preventing circuits 123 to 125.

An output of one part of PLA 129 is connected to a data terminal of DF/F130, and an output "Q" thereof is applied to the AND section of the PLA and is fed back as another input of PLA129. A signal of 32 Hz is applied to a clock terminal of DF/F130.

Other outputs of PLA129 are connected to the set terminals of S-RF/F131–134, and a signal "SWRST" from the control circuit 4 is applied to the reset terminals of S-RF/F131–134. An output "Q" of S-RF/F131 is applied to a control circuit 4 as the FNC signal and is connected to a first input terminal of OR-gate 135. An output "Q" of S-RF/F132 is applied to the control circuit 4 as the INC-signal and is connected to a second input terminal of OR-gate 135 and is applied to AND-PLA139. An output "Q" of S-RF/F133 is applied to the control circuit 4 as the COM signal and is connected to a third input terminal of OR-gate 135. An output "Q" of S-RF/F134 is applied to the control circuit 4 as the SRST signal and is connected to fourth input terminal of OR-gate 135.

An output of OR-gate 135 is applied to a set terminal of S-RF/F136, and a signal "SWRST" is applied to a reset terminal of S-RF/F136. Further, an output "Q" is applied to the timing pulse generating circuit 2 as the "SWFLG"-signal.

On the other hand, a set input of S-RF/F132 is connected to a clock input of T-F/F (Trigger flip flop) 137, the Q and $\overline{Q}$ outputs thereof are applied to AND.PLA 139, and the Q output thereof is also applied to a clock terminal of F/F 138. An output of the AND.PLA is applied to the control circuit 4 as the INC 1–4 signals.

Referring now to the operation of the present invention the construction described above:

If S-RF/F131 to 134 are reset when three switches, 120 to 122, are turned OFF, and all of F/F 126 to 128, 130 to 134 are completely maintained "L".

In said condition, when a switch 120 is turned ON, the Q output of DF/F 126 becomes "H", a column 142 of a PLA 129 is selected, a data input of each DF/F150 and 151 in DF/F group 130 becomes "H", the Q outputs thereof become to "H" after a delay of one period of the 32 Hz clock signal whereby a column 147 of a PLA 129 is selected. However, the column 147 is not changed to "H" during the interval that the Q output of DF/F126 is maintained "L".

When the switch 120 is turned OFF, the Q output of DF/F147 becomes "H", S-RF/F133 is set, and the COM signal becomes "H". Further, S-RF/F136 is set whereby the SWFLG signal becomes "H". A set input of S-RF/F is returned to "L" since Q output of DF/F150 becomes "L" after one clock period.

When a switch 120 was switched in condition of a switch 122 which was maintained ON, S-RF/F132 is set by the above noted operation whereby the INC signal becomes "H". The condition or state of TF/F137 is inverted since a set input of S-RF/F132 is connected to the clock input of TF/F137. As a result, INC-1 of AND-PLA 139 is selected whereby INC-1 becomes "H".

Further, when a switch 120 was switched, F/F137 and 138 operate to count whereby INC-2 becomes "H". In this embodiment, the number of times the switch 120 is switched is memorized until four times.

Figure 6:
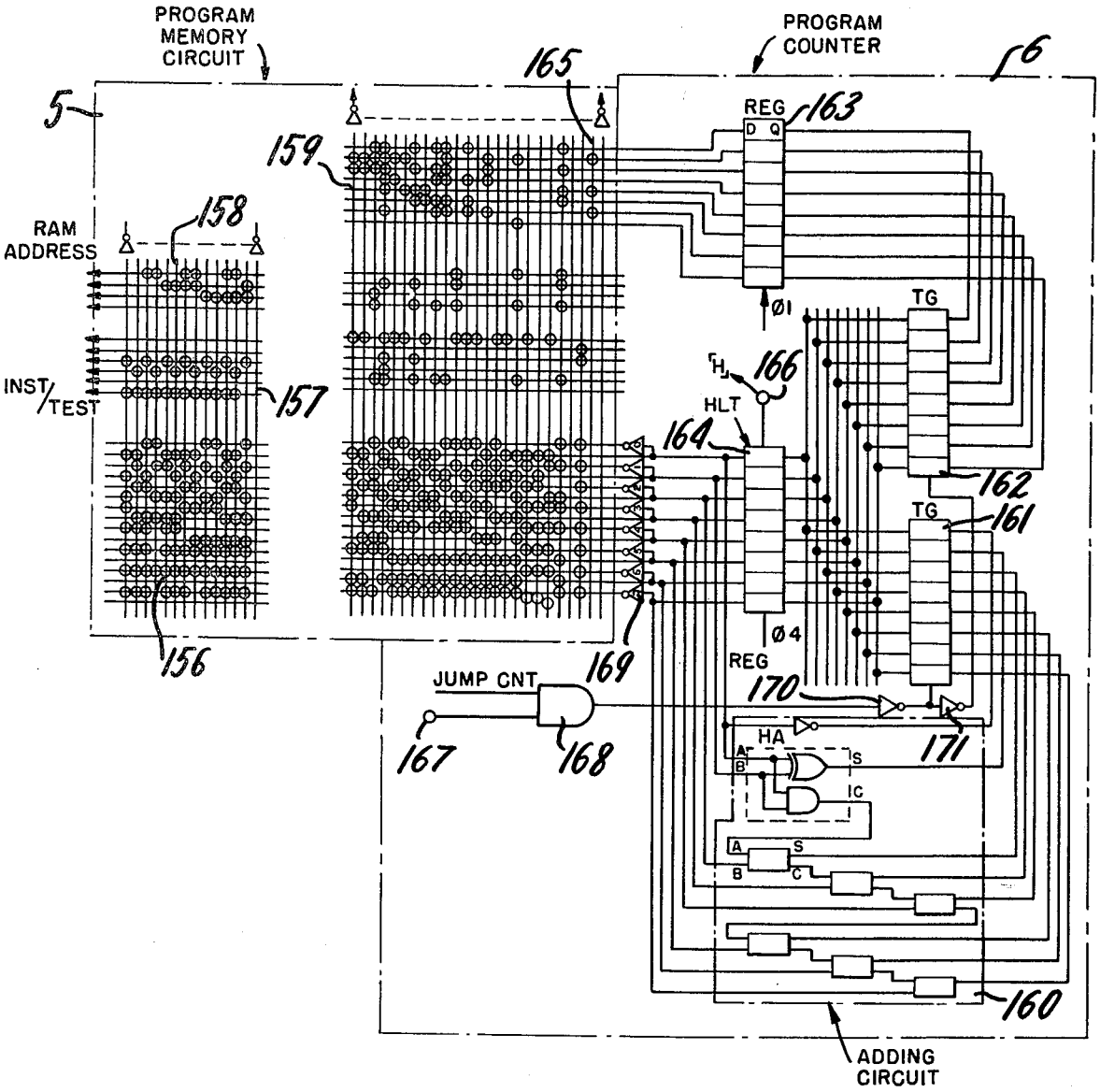
FIG. 6 shows the circuit constructions of a program memory and a program counter.

Referring now to a program memory circuit and a program counter in FIG. 6:

Numeral 5 is a ROM for a program memory 156 is an address decoder, 157 to 159 are data circuits. The data circuit include a command or a test code memory circuit 157, a RAM address 158 and a jump address memory.

Numeral 6 is a program counter, wherein 160 is an 8-bits parallel adding circuit in which eight outputs are applied to an electronic switch group 161. An output of electronic switch group 161 is connected to an output of another electronic switch group 162 to allow creation of a wired OR and is connected to a data input terminal of an address register 164.

An output of address register 164 is connected to an input of eight bits adding circuit 160, and is also applied to an address decoder 156 ROM155 via an inverter group 169.

An output of a jumping address memory 159 is connected to a data input of the jump address register 163, and an output of the register 163 is applied to an electronic switch 162.

An output of the electronic switch 162 is connected to an output of the electronic switch 161 and is applied to the register 164. Further a set terminal of a register 164 is connected to an outer terminal 166.

On the other hand, a signal "JUMPCNT" from the control circuit 4 is applied to one input of AND gate 168, an outer or external terminal 167 is connected to another input of said AND gate 168.

An output of AND circuit 168 is applied to a control terminal of the electronic switch 161 via inverter 170 and is applied to a control terminal of an another electronic switch 162 via an inverter 171.

Referring now to an operation in the above described construction:

When all of the outputs of the address register 164 are "0", address "00" of ROM5 is selected whereby a data word "000110" is generated from the command test code memory circuit 157, a data word "0000" is generated from the RAM address memory circuit 157, a data word "0000" is generated from RAM address memory circuit 158, a data word "01010010" namely address "52" is generated from a jump address memory circuit 159. Whereby a discrimination "SWFLG=1" is executed, a command of address "01" is executed in case of a condition of truth, and it jumps to address "52" in case of a condition of sham.

When each of the data words are generated, the eight bit adding circuit 160 generates a data word "01" after added "1" to address "00", and further, the register 163 reads the data word "52" and generates.

The control circuit 4 discriminates between logic levels H/L of a signal "SWFLG", and changes a signal "JUMPCNT" to "H", and changes a signal "JUMPCNT" to "L". When the signal "JUMPCNT" is "H", the electronic switch 161 is changed to "ON" whereby an information signal "01" is applied to the register 164. On the other hand, when the signal "JUMPCNT" is "L", the electronic switch 162 is changed to "ON" whereby an output "52" of the register 163 is applied to the register 164 which reads the information signal and executes an operation of address "01" or "52".

On the other hand, outer or external terminals 166 and 167 are test terminals, wherein the terminal 167 is normally "H" level, a terminal 166 is normally "L" level.

The signal level of the terminal 166 sets an output of the register 164. By changing the terminal signal level to "H" level, in the present embodiment, the output of register 164 is set to "AO" (10100000). A program for a test of the data memory 8 is memorized in an address "AO". Therefore, the test program is easily started from a test address by changing the terminal 166 to "H" level.

The a terminal 167 has a jump inhibition function. A program jump is inhibited in "L" level whereby a program is sequentially executed without a jump from "00" to "FF".

Referring now to the decoder circuit 9, the latch circuit 10 and the drive circuit 11:

The signals DOF, DNU and DAP from the control circuit 4 and the four signals from the data bus are applied to AND-circuit 180 of the decoder 9, and the segment signals a–g are generated from OR circuit 181 and are applied to a data terminal of the latch circuit 10.

An output "a" of a decoder 9 is connected to the segment drive latch "a" of the display digits, further an output "b" is connected to a segment drive latch "b".

On the other hand, the signals DGT-1 to 4 from the control circuits 4 are applied to a clock input of a latch circuit which corresponds to each of digits 1 to 4.

Further, an output "Q" of the latch circuit 10 is connected to one input of a driving EX-OR, and 32 Hz from the dividing circuit 101 is connected to an another input of said driving EX-OR.

Referring now to the operation of the above described circuit construction:

An information signal of 4-bits on the data bus is changed to a 7-segment display signal by the decoder 9. At this time, simultaneously one of the DOF, DNU and DAP signals becomes "H", the 4-bits data bus signal is changed to a segment signal for indicating numerals 6 to 9 when DNU is "H", and further said 4-bits data bus signal is changed to a segment signal for indicating A or P when DAP is "H". Additionally, signals a to g are changed to "0" when DOF is "H".

The changed signals a to g are applied to a data terminal of a latch circuit, only a certain digit be able to read a data by changing one signal of clock signals DGT1–4 to "H".

Further, a read data word is memorized until a next read operation is executed whereby a display is statically driven.

Figure 8:
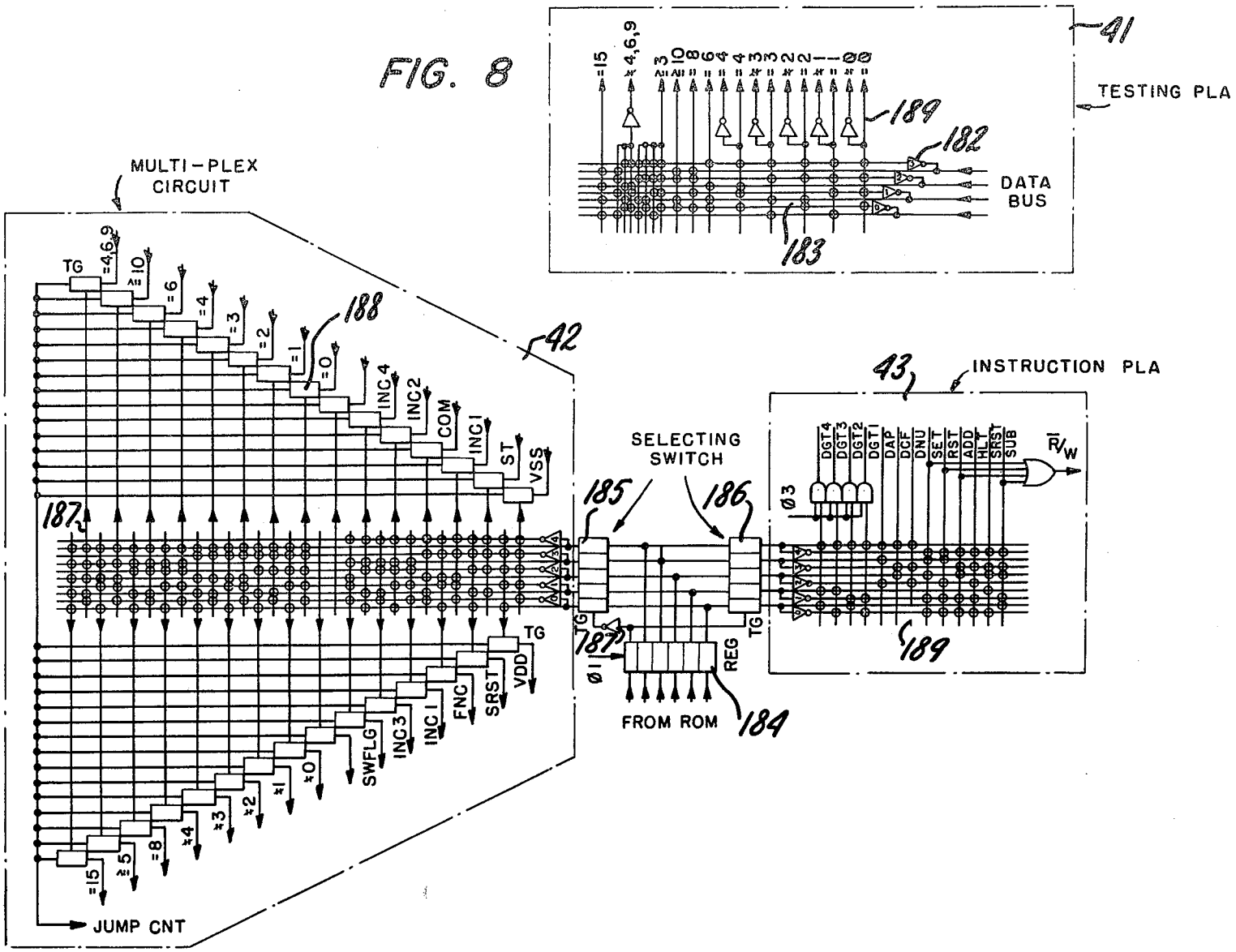
FIG. 8 shows the circuit construction of a control circuit.

Referring now to the control circuit of FIG. 8:

Numeral 41 is a test PLA. A signal of the data bus is applied to AND decoder 183 of the test PLA 41, and an output of said decoder 183 is applied to a data terminal of a multi-plexer 42.

On the other hand, a command discrimination data word of 5-bits from the ROM is applied to the selecting switches 185 and 186 via a register 184, and a F/I (Format Indicater) of another 1-bit is applied to a control terminal of said selecting switch 186 and is applied to a control terminal of said selecting switch 185 via an inverter 187. An output of said selecting switch 185 is applied to an address decoder of said multiplexer 42, and an output of said selecting switch 186 is applied to a decoder of an instruction PLA 43.

In the above noted construction, a command condition discriminating data word which was generated from a program memory 5 is read by a register 184. At this time, if a lowest bit F/I of a data is "0", said selecting switch 185 turns ON, said selecting switch 186 turns OFF, and output of a register 184 is applied to an address portion of the multiplexer 42. If an input code was "10000", an address line 187 is selected whereby a selecting switch 188 turns "ON".

A data input of said switch 188 is connected to an output 189 of the TEST PLA 41 and turns to signal level "H" only during an interval that a data word on the data bus is "0000".

An output of the switch 188 is maintained in a wired OR condition with another switch group and is applied to a program counter 6 as a signal "JMPCNT".

Further when the F/I is "1", the selecting switch 186 turns ON, and data from ROM5 is applied to an instruction PLA 43. For instance, when a data word is "01100", an output line 189 is selected whereby a command "SET" is applied to ALU7, and a signal R/W (READ/WRITE) which is connected to the data RAM portion 8 turns "H".

Figure 9:
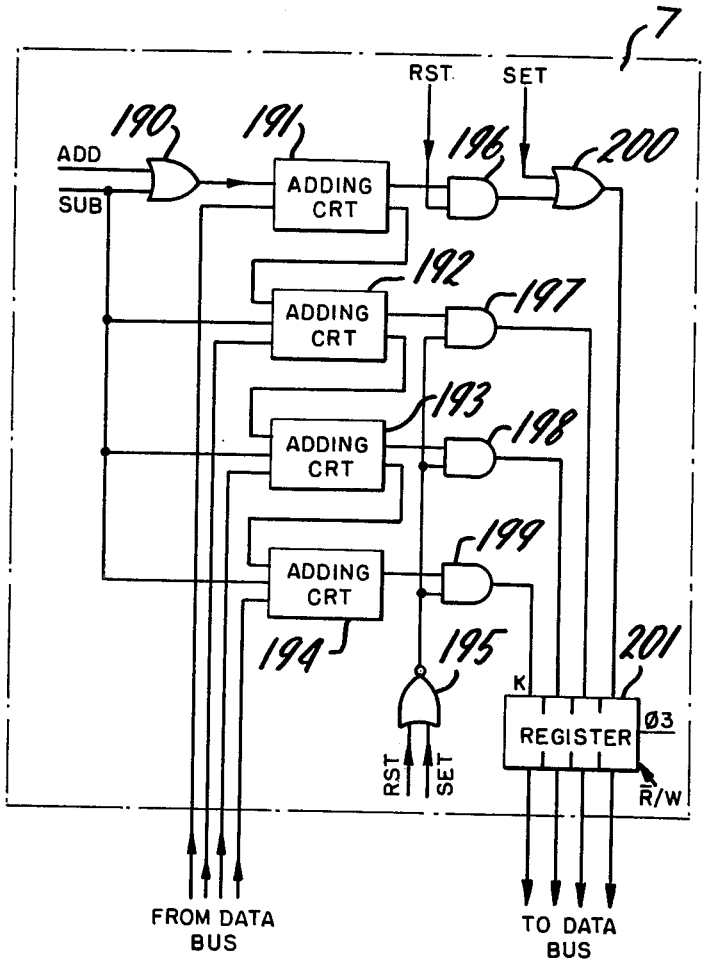
FIG. 9 shows a programing circuit construction.
Figure 10:
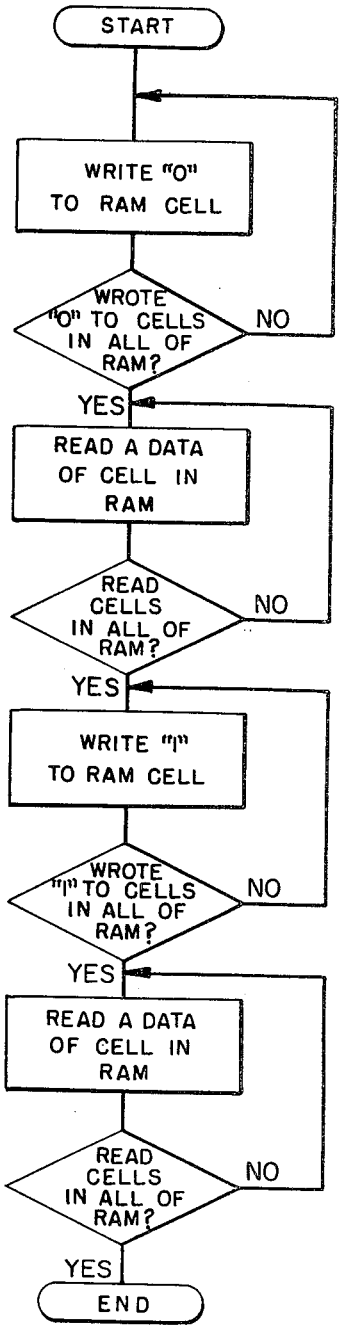
FIG. 10 shows a flow chart of a test program.

Further referring now to an operation circuit 7 in FIG. 9:

Numerals 191 to 194 are adders, and 191 is a half adders, 192 to 194 are full adder.

One terminal of the input of said half adder 191 is connected to a lowest bit of the data bus, and first input terminals of said full adders 192 to 194 are connected to a signal line of 3-bits of said data bus.

The second inputs of said full adders 192 to 194 are connected to a down counting command signal "SUB" from a control portion 4, a carry output of said half adder 191 is applied to a third input of said full adder 192, a carry output of said full adder 192 is applied to a third input of said full adder 193, and a carry output of said full adder 193 is applied to a third input of said full adder 194.

On the other hand, a signal "SUB" from a control circuit 4 is applied to OR-gete 190 together with a signal "ADD", and further an output of said OR-gate 190 is connected to another input terminal of a half adder 191. The output of each of the adders 191 to 194 is connected to one an input terminal of a respective one of AND-gates 196 to 199.

Other signals "SET and RST" from said control circuit 4 are respectively applied to NOR-gate 195, a signal "RST" is applied to one terminal of AND-gate 196, and a signal "SET" is applied to one terminal of OR-gate 200.

Further, an output signal of NOR-gate 195 is applied to another terminals of input terminal of each of the AND-gates 197 to 199.

An output of AND-gate 196 is connected to one input terminal of OR-gate 200, and an output of OR-gate 200 is applied to the data terminals of a register 201 in a same manner of the outputs as AND-gates 197 to 199.

A register 201 develops three state outputs, a signal $\overline{R}/\overline{W}$ from a control circuit 4 is applied to and the control terminal of said register 201. Further an output of said register 201 is connected to the data bus.

In the above noted circuit construction, in case of execution of an adding command, data from RAM 8 appears on the data bus, and the signal "ADD" from the control circuit 4 turns "H". Therefore, a data word from data bus and a data word "0001" according to a signal "ADD" are applied to an adding circuit, whereby a data word obtained by adding "1" to a data word of the data bus is generated.

A resulting data word is read to a register 201 via AND-gates 196 to 199, and is generated and applied by the data bus when a signal R/W became "H". At this time, signals RST, SET and SUB are "L" level.

A down counting command "SUB" is similar to the above noted condition, and in this case, a down counting operation is executed by adding "1111". Further a command "RST" is similarly executed and all of the outputs of AND-gates 196 to 199 are turned "L" level by turning a signal "RST" by "H" level without connection to a data word of the data bus, and are read to said register 201.

On the other hand, a command "SET" turns the outputs of AND-gates 197 to 199 to "L" level by turning a signal "SET" to "H", and a data word "0001" is read by register 201 by turning an output of the OR-gate 200 to "H" level.

According to the present invention, it is possible to automatically execute a test program by memorizing a test program in a program memory circuit and turning an outer terminal to a testing condition whereby a condition of the data memory circuit is able to be tested.

Similarly, an address of a program memory circuit is sequentially executed from a lower address to a higher address without a jump condition by turning another terminal to a testing condition whereby shortening of a testing time and simplification of the test are easily attained.

We claim:

1. An electronic timepiece, comprising: an oscillator and divider circuit for generating repetitive signals; program memory means for storing a program which executes operations for carrying out multiple functions, said program memory means including means for storing a test program for testing the operation of the timepiece; a program counter for addressing said program memory means, said program counter comprising an address register for storing memory addresses, an adder connected to receive the address stored in said address register for adding an address increment to the address received from said address register, and address selecting means responsive to a control signal for selecting between the incremented address from said adder and a jump address and for applying the selected address to said address register; data memory means for storing time information data and arithmetic operation data; operating means cooperative with said data memory means for executing arithmetic operations, data comparison operations and data conversion operations; decoding means for decoding data to be displayed; latching means for accumulating the decoded data developed by said decoding means; display means for displaying the information represented by the decoded data accumulated in said latching means; control means receptive of program data from said program memory means for applying control signals to said address selecting means of said program counter, said operating means, said data memory means, said decoding means and said latching means for operating the timepiece under control of the program stored in said program memory means, wherein said control means and said program counter together include preset means for addressing the test program stored in said program memory means for testing the timpiece by operating it according to the test program; and timing pulse generating means receptive of the repetitive signals from said oscillator and divider circuit for generating timing pulses and for applying the timing pulses to said program memory means, said program counter, said operating means, said data memory means, said decoding means and said control means for operating the same in synchronism.

2. An electronic timepiece as claimed in claim 1, wherein said program counter includes jump address inhibiting means for inhibiting execution of the operating program in response to a jump address.

3. An electronic timepiece as claimed in claim 1, wherein said program memory means is comprised of a read only memory, and wherein said data memory means is comprised of a random access memory.

* * * * *